United States Patent [19]

Shiono

[11] Patent Number: 4,618,936

[45] Date of Patent: Oct. 21, 1986

[54] SYNTHETIC SPEECH SPEED CONTROL IN AN ELECTRONIC CASH REGISTER

[75] Inventor: Fusahiro Shiono, Habikino, Japan

[73] Assignee: Sharp Kabushiki Kaisha, Osaka, Japan

[21] Appl. No.: 452,941

[22] Filed: Dec. 27, 1982

[30] Foreign Application Priority Data

Dec. 28, 1981 [JP] Japan ..... 56-212705
Dec. 28, 1981 [JP] Japan ..... 56-212706

[51] Int. Cl.[4] ..... G10L 5/00
[52] U.S. Cl. ..... 364/513.5; 381/51
[58] Field of Search ..... 381/51-53, 381/34; 364/200, 900

[56] References Cited

U.S. PATENT DOCUMENTS 3,641,496 2/1972 Slavin ..... 381/51
3,949,175 4/1976 Tanizoe et al. ..... 381/34
3,996,554 12/1976 Ives et al. ..... 381/51
4,040,027 8/1977 van Es et al. ..... 364/900
4,435,832 3/1984 Asada et al. ..... 381/34
4,464,784 8/1984 Agnello ..... 381/34

*Primary Examiner*—E. S. Matt Kemeny
*Attorney, Agent, or Firm*—Birch, Stewart, Kolasch and Birch

[57] ABSTRACT

An electronic cash register system includes an input keyboard and a high-speed computer which outputs through a buffer to a low-speed speech synthesizer. To avoid loss of data due to buffer overfill, a speech condition determination unit generates a control signal if the empty-condition of the buffer falls below a threshold. In one embodiment the control signal speeds up the speech synthesizer clock. In a second embodiment the keyboard is disabled.

13 Claims, 10 Drawing Figures

SYNTHETIC SPEECH SPEED CONTROL IN AN ELECTRONIC CASH REGISTER

BACKGROUND AND SUMMARY OF THE INVENTION

The present invention relates a synthetic speech control system in an electronic apparatus and, more particularly, to a speech speed control system in an electronic cash register which includes a synthetic speech system.

Generally, the synthetic speech speed is slower than the calculation speed responding to the key operation in an electronic apparatus. Accordingly, there is a possibility that new information must be audibly announced before the last information announcement is completed. Thus, in the prior art system, the previous part of the last message may be omitted due to the new message.

In order to prevent the above-mentioned defect, a synthetic speech system has been developed wherein the speech data is first stored in a buffer memory and the speech anouncement is conducted in accordance with the speech data stored in the buffer memory. However, even in such a system, accurate announcement is not ensured when the speech data exceeds the capacity of the buffer memory. Furthermore, the time delay of the speech announcement becomes long when the speech data is introduced into the buffer memory at a considerably high speed.

Accordingly, an object of the present invention is to provide a synthetic speech control system which ensures accurate announcement even when the speech data is introduced into the system at a considerably high speed.

Another object of the present invention is to provide a synthetic speech speed control system in an electronic cash register having a synthetic speech generation system.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, the speech data is first introduced into a buffer memory. The speech data stored in the buffer memory is sequentially read out and applied to a synthetic speech generation system. A first detection system is provided for detecting the data input condition into the buffer memory. A second detection system detects the speech generation condition conducted by the synthetic speech generation system. A determination is carried out through the use of output signals derived from the first and second detection systems in order to check the empty capacity of the buffer memory. When the empty capacity of the buffer memory is less than a preselected value, a control signal is developed to speed up the synthetic speech generation operation.

In another preferred form, when the empty capacity of the buffer memory is less than a predetermined value, a control signal is developed in order to preclude the key input operation to be conducted to the electronic cash register. That is, the key input operation can be conducted only when the buffer memory has the memory capacity sufficient to store the new speech data.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIGS. 2, 2(A) and 2(B) are flow charts for explaining an operational mode of the electronic cash register of FIG. 1;

FIGS. 6, 6(A) and 6(B) are flow charts for explaining an operational mode of the electronic cash register of FIG. 5.

DESCRIPTION OF THE PREFERRED EMBODIMENTS

Figure 1:
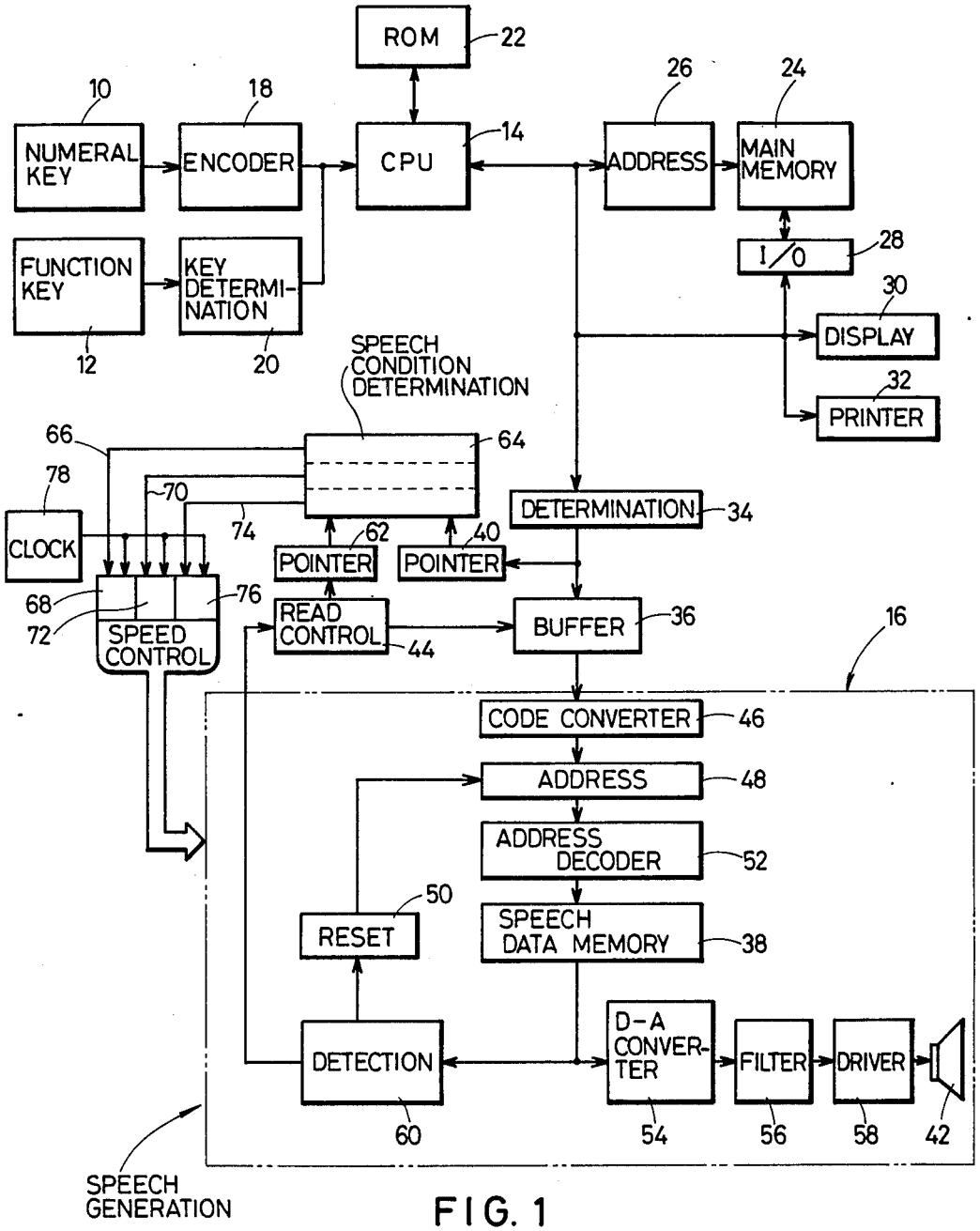
FIG. 1 is a block diagram of an embodiment of an electronic cash register of the present invention.

The electronic cash register of FIG. 1 comprises a numeral data key input system 10, a function key input system 12, a central processor unit 14 and a synthetic speech generation circuit 16.

Figure 2A:
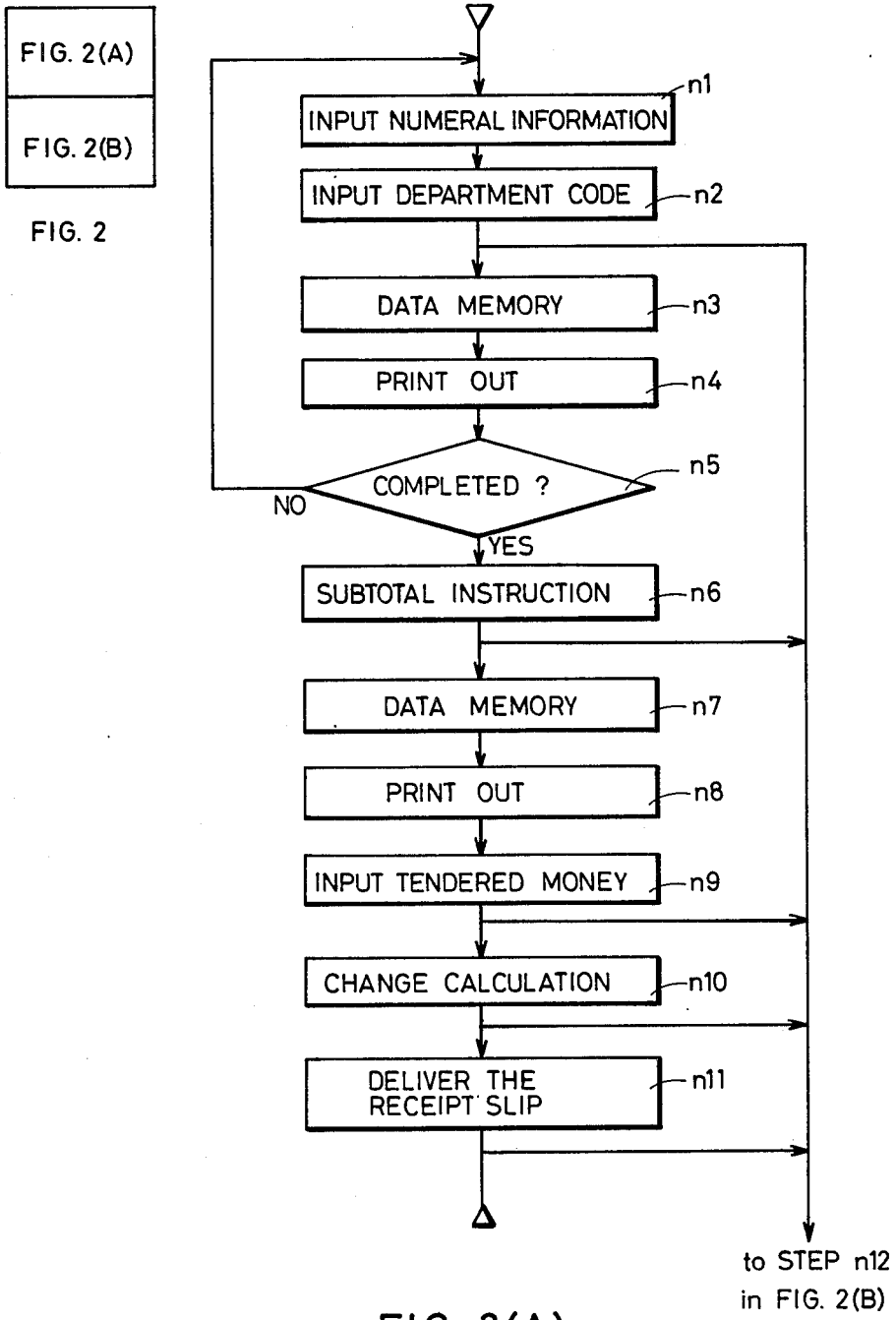
Figure 2:
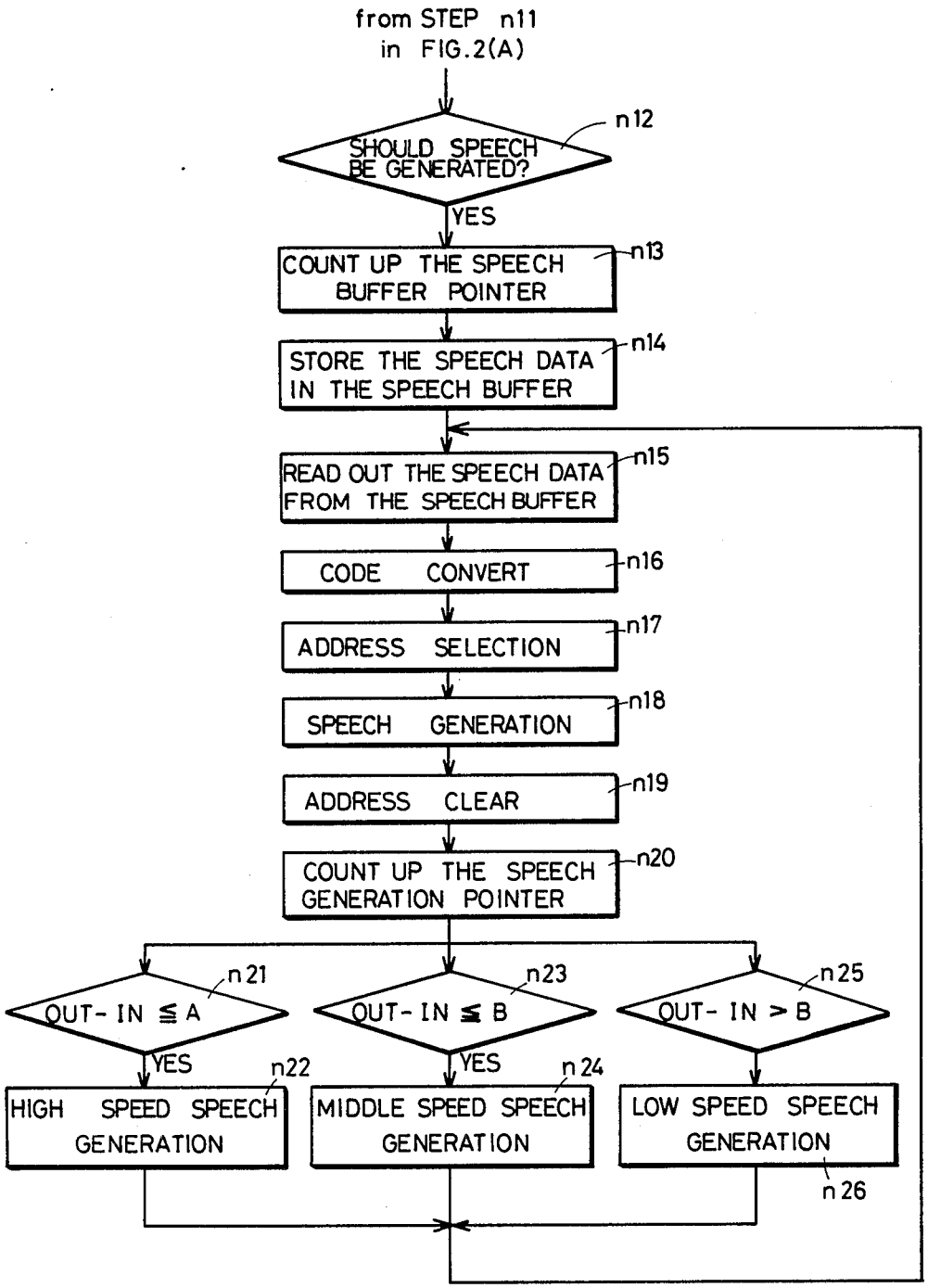

When numeral data is introduced through the numeral data key input system 10, the numeral data is introduced into the central processor unit 14 via a key encoder 18 (step n1 in FIG. 2(A)). The numeral data may be the number of the commodities purchased by a customer. Then, the function key input system 12 is operated to introduce the department information into the central processor unit 14 through a key determination circuit 20 (step n2). The central processor unit 14 performs the calculation in response to the data introduced through the numeral data key input system 10 and the function key input system 12 in accordance with programs stored in a read only memory 22. The calculation result is applied to the synthetic speech generation circuit 16 to generate the announcement of, for example, "twelve dollars".

The thus introduced and calculated data is introduced into and stored in a main memory 24 for registration purposes (step n3). More specifically, an address circuit 26 selects a desired memory section in accordance with a control signal developed from the central processor unit 14, and the registration data is introduced into the selected memory section via an input/output control circuit 28. Furthermore, the registration data is applied to a display system 30 and a printer 32 (step n4). That is, the registration data is displayed on the display system 30, and is printed out onto, for example, a receipt slip by means of the printer 32.

When the completion of the registration operation is detected (step n5) in response to the actuation of a subtotal key included in the function key input system 12, the subtotal operation is conducted (step n6). The calculated subtotal data is applied to the synthetic speech generation circuit 16 for generating announcement, for example, "The total ammount is ninety-five dollars". The subtotal data is stored in a desired memory section in the main memory 24 (step n7), and is applied to the printer 32 (step n8).

The money tendered by the customer is introduced through the use of the numeral data key input system 10 and the function key input system 12 (step n9). The money data is applied to the synthetic speech generation circuit 16 for generating audible announcement, for example, "The tendered money is one hundred dollars". Then, the central processor unit 14 calculates the change (step n10). The calculated change information is applied to the synthetic speech generation circuit to generate the announcement, for example, "Change is five dollars". These data are applied to the printer 32 for delivering the receipt slip (step n11). At this moment, the synthetic speech generation circuit 16 announces, for example, "Thank you for your patronage".

The electronic cash register of the present invention further includes a determination circuit 34 for conducting a determination as to whether the data developed from the central processor unit 14 should be audibly announced through the use of the synthetic speech generation circuit 16 (step n12). If an affirmative answer is obtained by the determination circuit 34, the data developed from the central processor unit 14 is introduced into and temporarily stored in a speech data buffer memory 36 (step n14). The data developed from the central processor unit 14 is converted by the determination circuit 34 into a code signal for selecting a desired speech data stored in a quantized speech data memory 38. Thus, the speech data buffer memory 36 stores the code signal for selecting the speech data stored in the quantized speech data memory 38. When one code signal is introduced into the speech data buffer memory 36, contents stored in a speech data buffer pointer 40 are increased by one (step n13). The above-mentioned code signal is developed in the syllable order. That is, the speech data buffer memory 36 stores the speech information in a syllable order and the count operation of the speech data buffer pointer 40 is conducted in the syllable order.

The synthetic speech generation circuit 16 includes the quantized speech data memory 38 and a speaker 42. The code signal stored in the speech data buffer memory 36 is read out through the use of a read out control circuit 44 (step n15), and is applied to a code converter 46 (step n16). An output signal of the code converter 46 is applied to an address counter 48. The address counter 48 is placed in a reset state by a reset circuit 50 when the speech generation is not conducted. When the address counter 48 is in the reset state, an address decoder 52 does not perform the address selection operation. When the address counter 48 is set to a desired value, the address decoder 52 functions to select desired addresses in the quantized speech data memory 38 (step n17). The quantized speech data stored in the selected address of the quantized speech data memory 38 is applied to a digital-to-analog converter 54. An analog signal developed from the digital-to-analog converter 54 is applied to the speaker 42 via a lowpass filter 56 and a speaker driver circuit 58, thereby generating the synthetic speech announcement (step n18).

When the announcement of one syllable is completed, the completion is detected by a detection circuit 60 which develops a control signal to activate the reset circuit 50. That is, the address counter 48 is cleared when the one syllable speech generation is completed (step n19). The control signal developed from the detection circuit 60 is also applied to the read out control circuit 44 for reading out the next code signal stored in the speech data buffer memory 36. The control signal developed from the detection circuit 60 is applied to a speech generation pointer 62. That is, the contents stored in the speech generation pointer 62 are increased by one when one syllable speech generation is completed (step n20). In this way, the synthetic speech announcement is generated in accordance with the data developed from the central processor unit 14.

Figure 3:
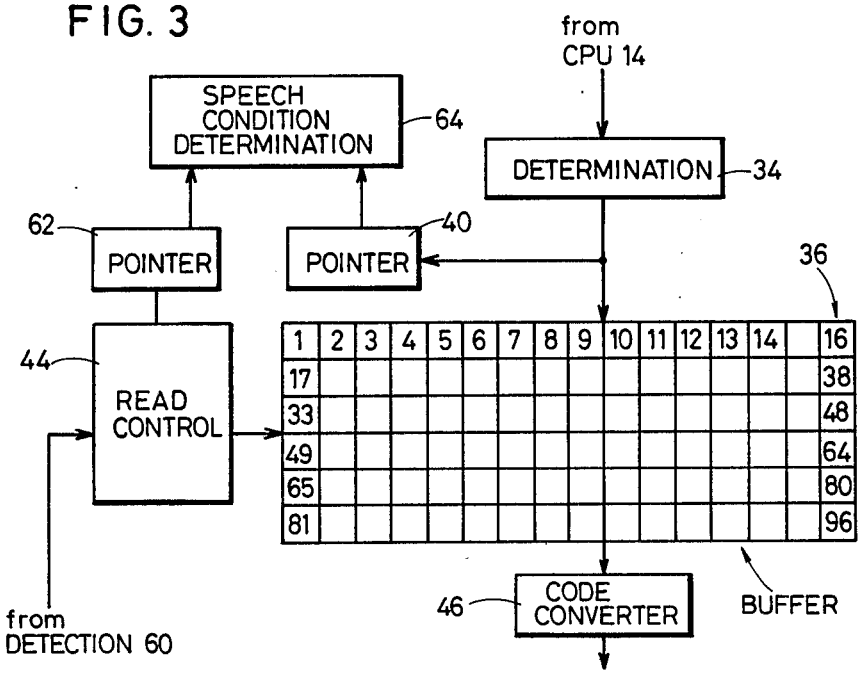
FIG. 3 is a detailed block diagram showing a speech data buffer memory included in the electronic cash register of FIG. 1.

The speech generation speed is slower than the calculation speed conducted by the central processor unit 14. Accordingly, the code signal stored in the speech data buffer memory 36 may increase even though the code signal stored in the speech data buffer memory 36 is sequentially read out through the use of the read out control circuit 44. FIG. 3 shows the storing operation and the reading operation which are conducted in connection with the speech data buffer memory 36. Now assume that the code signal developed from the determination circuit 34 has the syllable length as shown in the following TABLE I.

TABLE I

| | |
|---|---|
| first speech data | two syllable length |
| second speech data | four syllable length |
| third speech data | two syllable length |
| fourth speech data | four syllable length |
| fifth speech data | two syllable length |

The speech data buffer memory 36 has memory addresses 1 through 96 as shown in FIG. 3. When the above-mentioned first speech data is introduced into the speech data buffer memory 36, each syllable code signal is stored in the first and second addresses. The count contents of the speech data buffer pointer 40 are increased to "3". When the second speech data having four syllable length is introduced into the speech data buffer memory 36, each syllable code signal is introduced into the third through sixth addresses, respectively. The count contents of the speech data buffer pointer 40 become "7". Similarly, the code signals corresponding to the third speech data are introduced into and stored in the seventh and eighth addresses in the speech data buffer memory 36. The count contents of the speech data buffer pointer 40 are increased to "9". The code signals representing the fourth speech data are stored in the ninth through twelfth addresses of the speech data buffer memory 36. The count contents of the speech data buffer pointer 40 become "13". When the fifth speech data is developed from the central processor unit 14, the two syllable code signal is introduced into and stored in the thirteenth and fourteenth addresses of the speech data buffer memory 36, respectively. At this moment the count contents of the speech data buffer pointer 40 reach "15". In this way, the speech data is temporarily stored in the speech data buffer memory 36 in syllable order, and the speech data buffer pointer 40 counts the syllable number. The count contents stored in the speech data buffer pointer 40 indicate the address to which the next code signal should be introduced.

The thus introduced speech data (code signal) stored in the speech data buffer memory 36 is sequentially read out through the use of the read out control circuit 44. As is well known, an end code is provided at the end of each speech data. Thus, the code signals stored in the first and second addresses of the speech data buffer memory 36 are first read out sequentially, and are applied to the code converter 46. The count contents stored in the speech generation pointer 62 are increased to "3". When the speech generation of the first speech data is completed, the detection circuit 60 develops the control signal to perform the read operation of the next speech data stored in the addresses 3 to 6 of the speech data buffer memory 36. When the speech data stored in the addresses 3 to 6 of the speech data buffer memory 36 is read out, the count contents stored in the speech generation pointer 62 reach "7". In this way, the speech data (code signal) stored in the speech data buffer memory 36 is sequentially read out. The count contents stored in the speech generation pointer 62 indicate the address from which the next data should be read out.

When the code signal corresponding to the speech data applied to the determination circuit 34 is introduced into the ninety-sixth address of the speech data buffer memory 36, the next code signal is introduced into the first adrress of the speech data buffer memory 36, the former data stored in the first address being already read out for speech generation purposes. The speech data buffer pointer 40 performs the count operation from "1" after the count contents reach "96". The speech generation pointer 62 also counts the syllable number and performs the count operation from "1" after count contents reach "96".

The count contents stored in the speech data buffer pointer 40 and the speech generation pointer 62 are applied to a speech condition determination circuit 64. When the count contents stored in the speech data buffer pointer 40 are M40 and the count contents stored in the speech generation pointer 62 are M62, the speech condition determination circuit 64 conducts the calculation of the following equation (1).

$$M62-M40=\phi \quad (1)$$

Figure 4A:
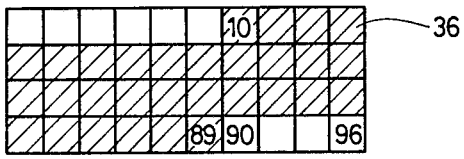
FIGS. 4(A), 4(B) and 4(C) are block diagrams for explaining operational modes of the speech data buffer memory of FIG. 3.
Figure 4B:
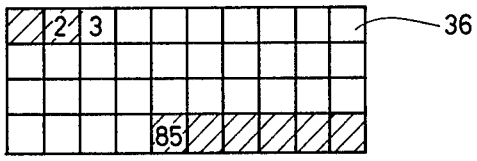
Figure 4C:
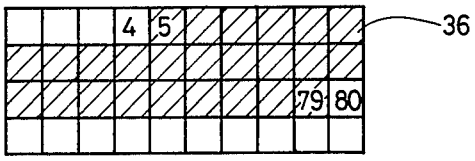

The value $\phi$ represents the storing and reading condition of the speech data buffer memory 36. FIGS. 4(A), 4(B) and 4(C) show the storing condition of the speech data buffer memory 36, wherein the hatched sections represent the addresses where the code signal (syllable speech data) is stored.

FIG. 4(A) shows a condition where the code signal is stored in the addresses 10 through 89. The first through ninth addresses, and the ninetieth through ninety-sixth addresses do not store any code signals. The count contents (M40) of the speech data buffer pointer 40 are "90", and the count contents (M62) of the speech generation pointer 62 are "10". Accordingly, the value $\phi$ is obtained from the equation (1) in the following manner.

$$\phi=10-90=-80 \quad (2)$$

When the negative value is obtained as the value $\phi$, the speech condition determination circuit 64 performs the calculation to add "96" (memory capacity of the speech data buffer memory 36) to the value $\phi$.

$$-80+96=16 \quad (3)$$

The $\phi$ value 16 represents the empty capacity in the speech data buffer memory 36.

FIG. 4(B) shows a condition where the code signal is stored in the addresses 85 through 2 in the speech data buffer memory 36. That is, the code signal is written into the speech data buffer memory 36 at the second address after the data introduction conducted to the last address (96), but the data read out operation is not yet conducted to the last address (96). The speech data buffer pointer 40 stores the count contents (M40) "3", and the speech generation pointer 62 stores the count contents (M62) "85". Accordingly, the following equation (4) is obtained by the speech condition determination circuit 64.

$$\phi=85-3=82 \quad (4)$$

The positive value "82" represents the empty capacity in the speech data buffer memory 36.

FIG. 4(C) shows a condition where the next speech data should be introduced into the eightieth address, and the next reading operation should be conducted from the fifth address. That is, the data introduction operation and the data read out operation is conducted to the respective addresses after passing the last address (96). The count contents stored in the speech data buffer pointer 40 are "80" (M40) and the count contents stored in the speech generation pointer 62 are "5" (M62). Accordingly, $$\phi=5-80=-75 \quad (5)$$

As in the case of the equation (3), the speech condition determination circuit 64 performs the following calculation.

$$-75+96=21 \quad (6)$$

The value "21" obtained by the calculation (6) represents the empty capacity of the speech data buffer memory 36.

Through the use of the empty capacity value ("16", "82" or "21") obtained by the calculation (equation (3), (4) or (6)) conducted by the speech condition determination circuit 64, the speech condition determination circuit 64 performs the following determination (step n21, n23 and n25 in FIG. 2(B)).

$$M62-M40\leqq A \quad (7)\ (\text{step n21})$$

$$M62-M40\leqq B \quad (8)\ (\text{step n23})$$

$$M62-M40>B \quad (9)\ (\text{step n25})$$

where:

A is the longest syllable number of the speech data which should be generated when one of the numeral keys included in the numeral data key input system 10 is actuated; and $B=10\times A$ When an affirmative answer is obtained at the step n21, the speech condition determination circuit 64 develops a high speed control signal on a line 66 to activate a high speed speech generation control circuit 68 (step n22). When an affirmative answer is obtained at the step n23, the speech condition determination circuit 64 develops a middle speed control signal on a line 70 to activate a middle speed speech generation control circuit 72 (step n24). When an affirmative answer is obtained at the step n25, the speech condition determination circuit 64 develops a low speed control signal on a line 74 to activate a low speed speech generation control circuit 76 (step n26).

A clock signal generator 78 is connected to the high speed speech generation control circuit 68, the middle speed speech generation control circuit 72 and the low speed speech generation control circuit 76. Each of the control circuits 68, 72 and 76 has the frequency division ratio D68, D72 and D76, respectively, which satisfies the following relationships.

$$D68 < D72 < D76 \quad (10)$$

The frequency divided signal developed from the speed control circuits 68, 72 and 76 is applied to the synthetic speech generation circuit 16 as a clock signal. That is, the high speed speech generation control circuit 68 develops a clock signal of a considerably high frequency, thereby conducting the speech generation at a high speed. The middle speed speech generation control circuit 72 develops a clock signal of a middle frequency, thereby achieving the speech generation at a middle speed. The low speed speech generation control circuit 76 develops a clock signal of a considerably low frequency, thereby conducting the speech generation at a low speed.

Figure 5:
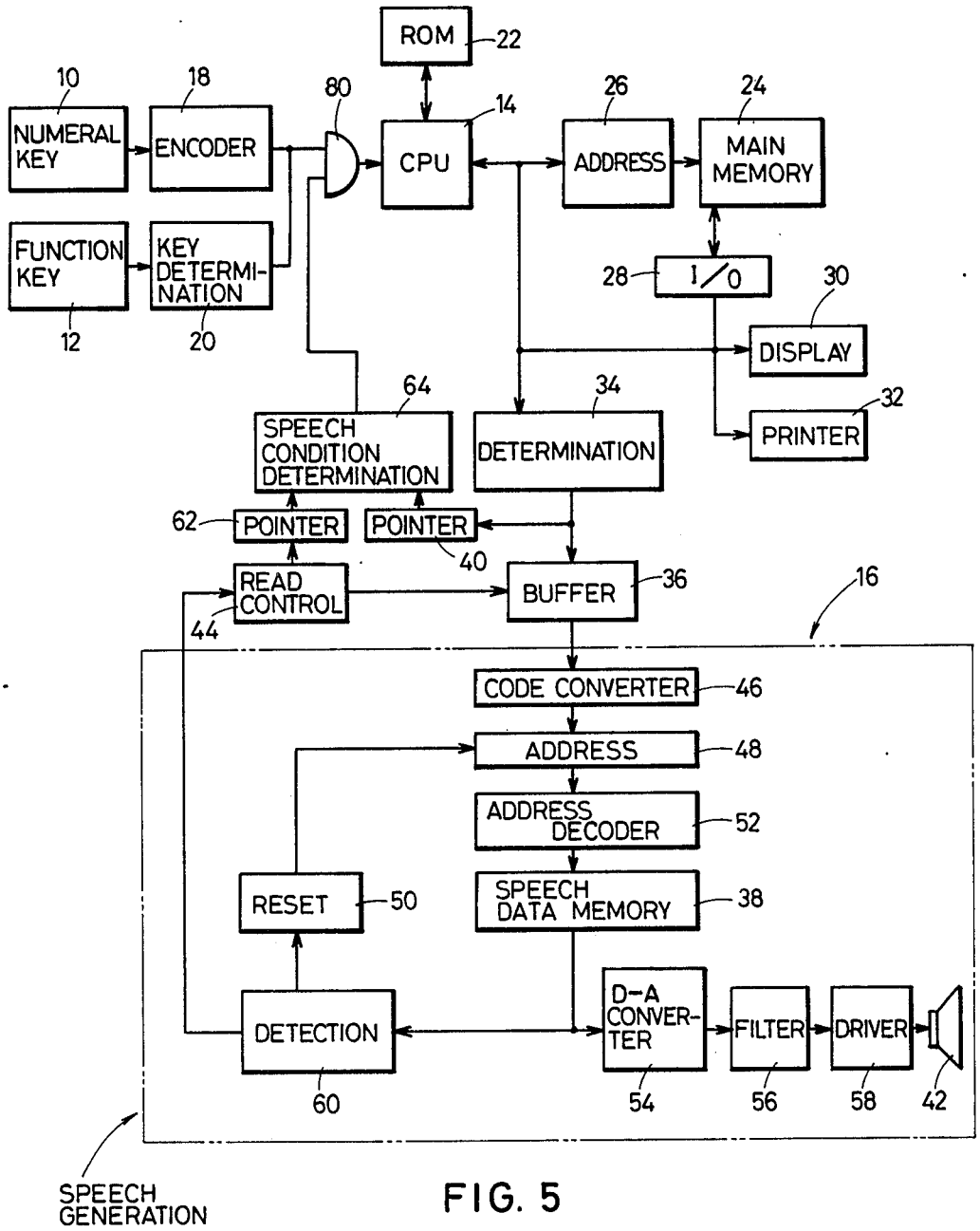
FIG. 5 is a block diagram of another embodiment of an electronic cash register of the present invention.
Figure 6A:
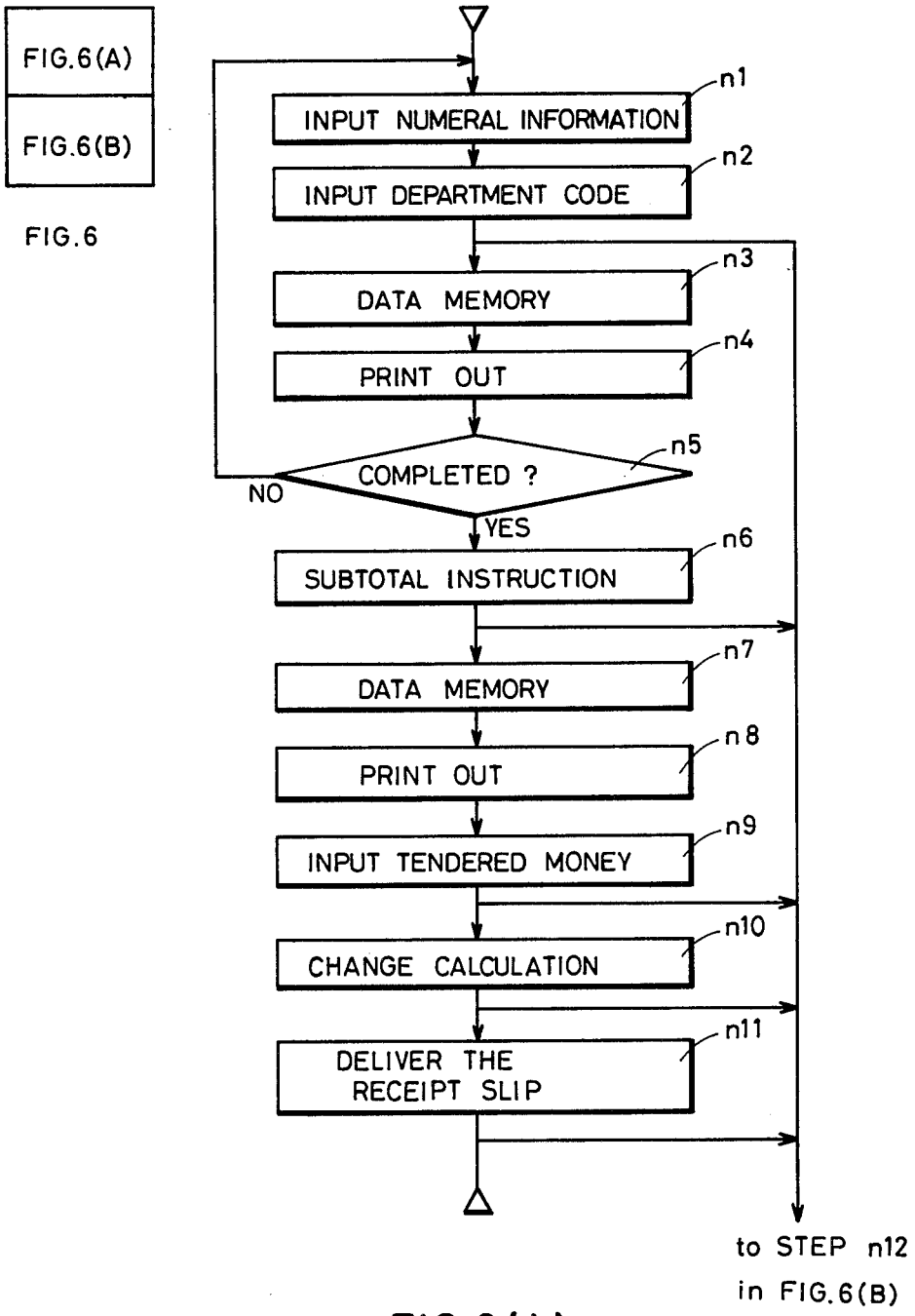
Figure 6:
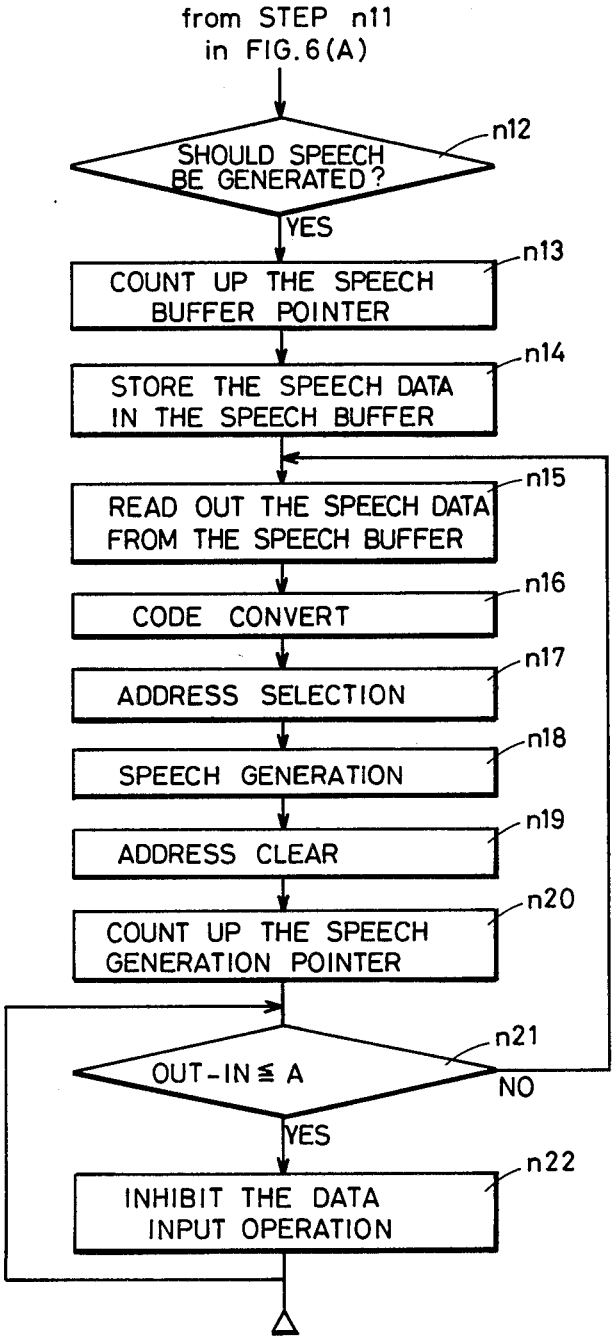

FIG. 5 shows another embodiment of the electronic cash register of the present invention. Like elements corresponding to those of FIG. 1 are indicated by like numerals. An operational mode of the electronic cash register of FIG. 5 is shown in FIGS. 6, 6(A) and 6(B). In the embodiment of FIG. 5, an AND gate 80 is disposed in front of the central processor unit 14 for gating output signals developed from the key encoder 18 and the key determination circuit 20.

An operational mode of the electronic cash register of FIG. 5 is similar to that of FIG. 1. More specifically, steps n1 through n20 of FIGS. 6(A) and 6(B) are identical to the steps n1 through n20 of FIGS. 2(A) and 2(B).

In the embodiment of FIG. 5, the speech condition determination circuit 64 performs the following determination (step n21 in FIG. 6(B)).

$$M62 - M40 \leqq A \quad (11)$$

If an affirmative answer is obtained at the step n21, the speech condition determination circuit 64 develops a low level signal to the AND gate 80. Thus, the data can not be introduced from the numeral data key input system 10 and the function key input system 12 (step n22).

When the empty capacity increases due to the actual speech generation conducted by the synthetic speech generation circuit 16, the speech condition determination circuit 64 develops a high level signal to open the AND gate 80. Under these conditions, new information can be introduced through the numeral data key input system 10 and the function key input system 12.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A synthetic speech generation control system comprising:

buffer memory means for temporarily storing speech data representative of audible speech;

a synthetic speech generation circuit, receiving said speech data from said buffer memory means and converting said speech data into audible speech;

write control means, operatively connected to said buffer memory means, for introducing the speech data into said buffer memory means at a selected writing speed;

read control means for controlling the read out of said speech data stored in said buffer memory at a selected reading speed and the application of said speech data to said synthetic speech generation circuit;

determination means for monitoring the writing speed of said write control means and the reading speed of said read control means, and for developing a control signal when said writing speed is faster than said reading speed; and control means, responsive to said control signal developed by said determination means, for increasing the reading speed of said read control means when said control signal is developed from said determination circuit.

2. The synthetic speech generation control system of claim 1, wherein said buffer memory means includes a predetermined number of memory sections, each memory section storing syllable information of said speech data.

3. The synthetic speech generation control system of claim 2, wherein said determination means comprises:

first counter means for counting the number of syllables of the speech data introduced into said buffer memory means by said write control means;

second counter means for counting the number of syllables of speech data read out from said buffer memory means by said read control means; and comparing means, responsive to the contents of said first and second counter means, for comparing the contents stored in said first and second counter means and for developing said control signal when the count difference is greater than a preselected number.

4. An electronic cash register including a synthetic speech generation system comprising:

key input means for introducing numeral data and operation commands into said electronic cash register;

central processor means, responsive to said numeral data introduced by said key input means, for conducting an arithmetic calculation on said numeral data;

buffer memory means for temporarily storing speech data developed from said central processor means representative of audible speech;

a synthetic speech generation circuit, receiving said speech data from said buffer memory means and converting said speech data into audible speech;

write control means, operatively connected to said buffer memory means, for writing the speech data developed by said central processor means into said buffer memory means at a selected writing speed;

read control means for controlling the sequential read out of said speech data stored in said buffer memory means and for applying said speech data to said synthetic speech generation circuit at a selected reading speed;

first storage means for storing a signal representative of a writing condition indicative of the speed with which data is written into said buffer memory under control of said write control means;

second storage means for storing a signal representative of a writing condition indicative of the speed with which data is read out of said buffer memory under control of said read control means; and synthetic speech speed control means, responsive to the signals stored in said first and second storage means, for varying the speed of the speech generation conducted by said synthetic speech generation circuit.

5. The electronic cash register of claim 4, wherein said buffer memory means includes a predetermined number of memory sections, each memory section storing syllable information of said speech data.

6. The electronic cash register of claim 5, wherein said first storage means stores an address number of said memory section to which the next syllable information should be introduced, and said second storage means stores an address number of said memory section from which the next syllable information should be read out.

7. The electronic cash register of claim 6, wherein said first storage means include a pointer, and said second storage means include another pointer.

8. The electronic cash register of claim 6, wherein said synthetic speech speed control means comprises:

a subtractor subtracting the address number stored in said second storage means from the address number stored in said first storage means to develop a subtraction result signal;

first determination means, responsive to the subtraction result signal developed by said subtractor, for determining whether the subtraction result obtained by said subtractor is greater than a first predetermined value to develop an affirmative determination signal; and first control signal developing means for developing a first control signal when an affirmative determination signal is developed by said first determination means, said first control signal being applied to said synthetic speech generation circuit so as to increase the speed of the synthetic speech generation operation.

9. The electronic cash register of claim 8, wherein said synthetic speech speed control means further comprises:

second determination means, responsive to the subtraction result signal developed by said subtractor, for determining whether the subtraction result obtained by said subtractor is smaller than a second predetermined value, said second predetermined value being less than said first predetermined value; and second control signal developing means for developing a second control signal when an affirmative determination signal is obtained by said second determination circuit, said second control signal being applied to said synthetic speech generation circuit so as to decrease the speed of the speech generation operation.

10. An electronic cash register including a synthetic speech generation system comprising:

key input means for introducing numeral data and operation commands into said electronic cash register;

central processor means, responsive to said numeral data introduced by said key input means, for conducting an arithmetic calculation on said numeral data;

buffer memory means for temporarily storing speech data developed from said central processor means representative of audible speech;

a synthetic speech generation circuit, receiving said speech data from said buffer memory means and converting said speech data into audible speech;

write control means, operatively connected to said buffer memory means, for writing the speech data developed by said central processor means into said buffer memory means at a selected writing speed;

read control means for controlling the sequential read out of said speech data stored in said buffer memory means and for applying said speech data to said synthetic speech generation circuit at a selected reading speed;

first storage means for storing a signal representative of a writing condition indicative of the speed into which data is written into said buffer memory under control of said write control means;

second storage means for storing a signal representative of a writing condition indicative of the speed with which data is read out of said buffer memory under control of said read control means; and key input control means for disabling said key input means in response to the signals stored in said first and second storage means.

11. The electronic cash register of claim 10, wherein said buffer memory means includes a predetermined number of memory sections, each memory section storing syllable information of said speech data.

12. The electronic cash register of claim 11, wherein said first storage means includes a pointer for storing an address number of said memory section to which the next syllable information should be introduced, and said second storage means includes another pointer for storing an address number of said memory section from which the next syllable information should be read out.

13. The electronic cash register of claim 12, wherein said key input control means comprises:

a subtractor subtracting the address number stored in said second storage means from the address number stored in said first storage means to develop a subtraction result signal;

determination means for determining whether the subtraction result obtained by said subtractor is greater than a preselected value to develop an affirmative determination signal;

control signal developing means for developing a control signal when the affirmative determination signal is developed by said determination means; and means, responsive to said control signal developed by said control signal developing means, for disconnecting said key input means from said central processor means.

* * * * *